United States Patent [19]

Yoshikawa

[11] Patent Number: 4,825,074

[45] Date of Patent: Apr. 25, 1989

[54] IMAGE RECORDING APPARATUS

[75] Inventor: Sumio Yoshikawa, Kanagawa, Japan

[73] Assignee: Fuji Photo Film Co., Ltd., Kanagawa, Japan

[21] Appl. No.: 39,852

[22] Filed: Apr. 20, 1987

[30] Foreign Application Priority Data

Apr. 18, 1986 [JP] Japan ..... 61-90371

[51] Int. Cl.[4] ..... G03C 5/16

[52] U.S. Cl. ..... 250/317.1; 250/318; 250/319; 250/316.1; 355/27; 355/28; 355/3 TR

[58] Field of Search ..... 250/316.1, 317.1, 318, 250/319; 355/28, 3 TR, 3 DR, 27; 219/216

[56] References Cited

U.S. PATENT DOCUMENTS 4,620,096 10/1986 Takehara ..... 250/319
4,629,675 12/1986 Takehara ..... 430/203
4,660,964 4/1987 Yoshikawa et al. ..... 250/317.1
4,665,303 5/1986 Miyakawa ..... 219/216
4,686,351 8/1987 Nakauchi ..... 219/216
4,737,822 4/1988 Taniguchi et al. ..... 250/318

*Primary Examiner*—Carolyn E. Fields
*Assistant Examiner*—John A. Miller
*Attorney, Agent, or Firm*—Sughrue, Mion, Zinn, Macpeak and Seas

[57] ABSTRACT

An image recording apparatus of the type in which a latent image formed on a heat-developable photosensitive material through exposure is developed and the developed image is then transferred to an image-receiving material so as to be recorded on said image-receiving material. The exposure is effected on the heat-developable photosensitive material wound on the outer peripheral surface of an exposure drum, and the development and the transfer of the image are conducted with the image-receiving material wound around the heat-developable photosensitive material on the exposure drum, whereby the size of the apparatus as a whole is remarkably reduced.

20 Claims, 10 Drawing Sheets

(A)

(E)

IMAGE RECORDING APPARATUS

BACKGROUND OF THE INVENTION

1. Field of the Invention

The present invention relates to an image recording apparatus of the type which employs a heat-developable photosensitive material which is first image-exposed and is subjected to a heat-development process so as to develop the image formed thereon, the thus developed image being then transferred to an image receiving material so as to be recorded in the latter.

2. Description of the Prior Art

Image recording apparatus have been heretofore known in which a heat-developable photosensitive material is image-exposed and then subjected to a heat-developing process for developing the image which is then transferred to an image receiving material so as to be recorded on the latter. A typical example of this type of apparatus is shown, for example, in Japanese Unexamined Patent Publication No. 75247/1984, corresponding to U.S. Pat. No. 4,620,096. The recording operation for recording an image with this known image recording apparatus have a plurality of steps including positioning the heat-developable photosensitive material at an exposure position, exposing the heat-developable photosensitive material to an original image, conveying the exposed heat-developable photosensitive material to a developing section by a conveyor device, heating the heat-developable photosensitive material so as to heat-develop the image, supplying the heat-developable photosensitive material to a transfer section and bringing the same into close contact with an image receiving material so as to transfer the image onto the image receiving material.

Thus, the known image recording apparatus of the type described requires various devices such as the developing device, image-receiving material supplying device and the transferred device to be installed downstream from the exposure section as viewed in the direction of movement of the heat-developable photosensitive material, with the result that the size of the apparatus as a whole becomes impractically large.

SUMMARY OF THE INVENTION

Accordingly, an object of the present invention is to provide an image recording apparatus of the type which makes use of a heat-developable photosensitive material, which is improved to reduce the size of the whole apparatus.

To this end, according to one aspect of the present invention, there is provided an image recording apparatus of the type in which a latent image formed on a heat-developable photosensitive material through exposure is developed and then transferred to an image-receiving material so as to be recorded on the image-receiving material, comprising: an exposure drum capable of holding the heat-developable photosensitive material wound on the outer peripheral surface thereof; an exposure head disposed to face the outer peripheral surface of the exposure drum and adapted for exposing the heat-developable photosensitive material on the exposure drum to an original image; image-receiving material supply means for supplying the image-receiving material onto the heat-developable photosensitive material on the exposure drum so as to wind the image-receiving material on the heat-developable photosensitive material; and developing transfer means for applying heat to the heat-developable photosensitive material and the image-receiving material on the exposure drum thereby developing the latent image on the heat-developable photosensitive material and transferring the developed image to the image-receiving material.

The heat-developable photosensitive material wound on the photosensitive drum is exposed to an original image through the exposure head, and then the image receiving material is fed by an image-receiving material supplying device so as to be superposed on the heat-developable photosensitive material on the exposure drum. In this state, the image on the heat-developable photosensitive material is heat-developed and the developed image is directly transferred to the image-receiving material by the operation of the heat-developing transfer device. Thus, the series of operation including exposure, development and transfer is conducted while the heat-developable photosensitive material is wound on the exposure drum, thus allowing the size of the image recording apparatus as a whole to be reduced remarkably.

According to another aspect of the present invention, an image-forming solvent is applied by a solvent application means to the heat-developable photosensitive material on the exposure drum, thus contributing to a further reduction in the size of the image recording apparatus.

The image-forming solvent used in the present invention is a solvent which is necessary for forming the image, such as water or an organic solvent having a low melting point, e.g., an alcohol, a ketone or an amide, with or without addition of one or more additives such as a surfactant, a development promotion agent and a development inhibitor.

The above and other objects, features and advantages of the present invention will become clear from the following description when the same is read in conjunction with the accompanying drawings.

DESCRIPTION OF THE PREFERRED EMBODIMENTS

Figure 1:
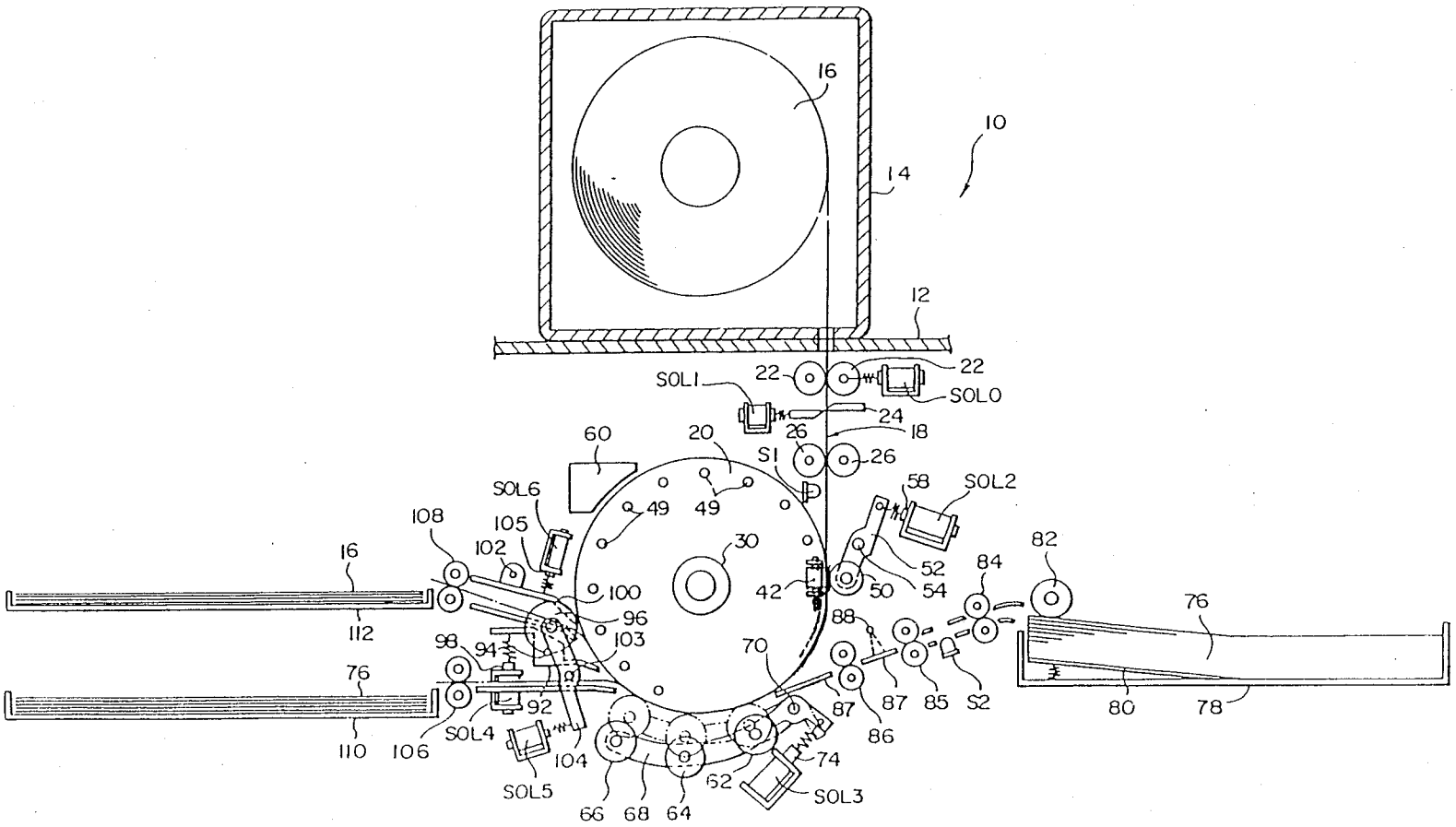
FIG. 1 is a sectional view of an embodiment of the image recording apparatus in accordance with the present invention.

Referring to FIG. 1, an image recording apparatus embodying the present invention is generally designated by a reference numeral 10. The image recording apparatus 10 has a main body 12 which detachably carries a magazine 14 accommodating a roll of a heat-developable photosensitive material 16.

The heat-developable photosensitive material is adapted to be extracted through a guide passage 18 in the direction tangent to an exposure drum 20 More specifically, a pair of supplying rollers 22 disposed immediately under the magazine 14 is adapted for extracting the heat-developable photosensitive material 16 and supplying the same towards the guide passage 18. A cutter 24 adapted to be actuated by a solenoid SOL1 is disposed immediately under the supply rollers 22, Another pair of supply rollers 26, as well as a sensor S1 capable of sensing the passage of the heat-developable photosensitive material 16, is disposed downstream from the cutter 24 as viewed in the direction of supply of the heat-developable photosensitive material 16.

Figure 2:
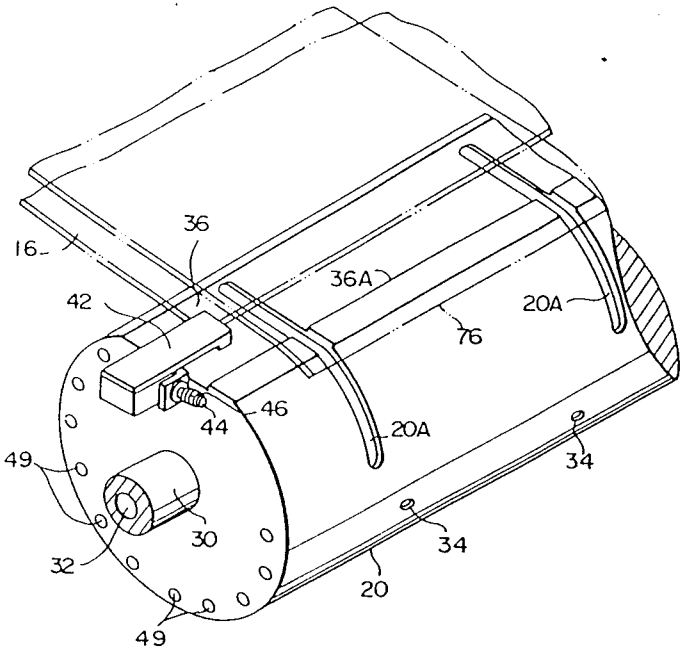
FIG. 2 is a perspective view of an exposure drum incorporated in the embodiment shown in FIG. 1.
Figure 5:
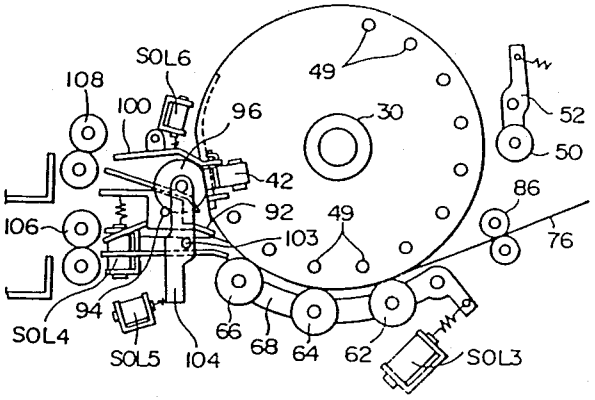
FIGS. 4 and 5 are illustrations of the same portion as that shown in FIG. 3 in different steps of operation.

As will be seen from FIG. 2, the exposure drum 2 is provided with support shafts 30 projected laterally therefrom and is rotatably supported at these shafts 30 by bearings which are not shown. A circular hole formed axially through the support shaft 30 is communicated with a vacuum suction means which is not shown, so that the interior of the exposure drum 30 can be evacuated to a predetermined level of vacuum. The photosensitive drum 20 also has a plurality of through holes 34 formed in the wall thereof so as to provide communication between the interior and the exterior of the photosensitive drum 20, so that the heat-developable photosensitive material wound on the exposure drum ca be securely held by the outer peripheral surface of the exposure drum 20 by the vacuum suction force transmitted through the through holes 34.

The outer peripheral surface of the exposure drum 20 is provided with a tangential flattened surface 36 for retaining the leading end of the heat-developable photosensitive material 16. The arrangement is such that the leading end of the heat-developable photosensitive material 16 is stopped by a step 36A in the flattened surface 36 and the widthwise end of the leading end is clamped between clips 42 and the flattened surface 36. Each clip 42 is pivotally secured at its mid portion to the exposure drum 20 through a pin 44, and is urged by a torsion coiled spring 46 such that its end is pressed onto the flattened surface 36 so as to clamp the heat-developable photosensitive material therebetween, thus securing the leading end of the heat-developable photosensitive material onto the outer peripheral surface of the exposure drum 20.

The exposure drum 20 also incorporates a heater 49 so that the heat-developable photosensitive material 16 and a later-mentioned image-receiving material 76 superposed in layers on the outer peripheral surface of the exposure drum are hated, whereby development of image by application of heat and transfer of developed image to the image-receiving material by application of heat are effected substantially simultaneously.

When the heat-developable photosensitive material 16 is supplied in a manner shown in FIG. 1, the exposure drum 20 is so stationed that the flattened surface 36 is aligned with the guide passage 18 as shown in FIG. 1. In this state, a clip release roller 50 engages with one end (left end as viewed in FIG. 2) of each clip 42 so as to keep the other end (right end as viewed in FIG. 2) of the clip slightly away from the flattened surface 36. Each clip release roller 50 is pivotally carried by the end of an arm 52 which in turn is secured to the main body 12 by a pin 54. The other end of the clip release roller 50 is connected to an actuator 58 associated with a solenoid SOL2.

The arrangement is such that, as the solenoid SOL2 is energized, the arm 52 is rotated about a pin 54 so that the clip release roller 50 contacts the clip 42 so as to move the end of the clip 42 slightly away from the flattened surface 36 so as to form a gap which receives the leading end of the heat-developable photosensitive material 16 fed along the guide passage 18. Then, as the solenoid SOL2 is de-energized, the clip 42 is pressed onto the flattened surface 36 by the urging force exerted by the torsion coiled spring 46, whereby the leading end of the heat-developable photosensitive material 16 is clamped between the flattened surface 36 and the clips 42. The clips 42, solenoids SOL2, arms 52 and the flattened surface 36 in cooperation constitute a locating means for locating the leading end of the heat-developable photosensitive material 16.

Referring again to FIG. 1, an exposure head 60 is disposed in the vicinity of the exposure drum 20 so as to allow the heat-developable photosensitive material 16 wound on the exposure drum 20 to be exposed to an original image as the drum 20 rotates. The exposure head 60 is capable of scanning in the direction perpendicular to the plane of the sheet carrying FIG. 1 so as to allow the entire surface of the heat-developable photosensitive material to be exposed.

A plurality of transfer pressing rollers 62, 64 and 66 constituting pressing means are disposed around the exposure drum 20. These transfer pressing rollers 62, 64 and 66 are rotatably supported by a transfer pressing arm 68 which is pivotally secured by a pin 70 to the main part 12 of the apparatus. The transfer pressing arm 68 has one end which is pivotally secured to an actuator 74 associated with a solenoid SOL3. The arrangement is such that the transfer pressing arm 68 is moved towards the outer peripheral surface of the exposure drum 20 only when the solenoid SOL3 is energized, thereby pressing the transfer pressing rollers 62, 64, 66 towards the exposure drum 20, thus bringing the heat-developable photosensitive material 16 into close contact with the outer peripheral surface of the exposure drum 20 around which it is wound. The transfer pressing arm 68 and the rollers 62 to 66, however, may be dispensed with if there is a suitable means for pressing the heat-developable photosensitive material 16 into close contact with the outer peripheral surface of the exposure drum 20.

After the image receiving material 76 is wound on the heat-developable photosensitive material 16 carried by the exposure drum 20, a heater 49 constituting a developing transfer means is supplied with electric power so as to generate heat by which heat-development of the latent image carried by the heat-developable photosensitive material 16 and the transfer of the image onto the image receiving material 16 are conducted substantially simultaneously.

The image-receiving material 76 is beforehand stored in a tray 86, in the form of a plurality of sheets stacked therein. The arrangement is such that the uppermost sheet of the image-receiving material 76 is fed onto the outer peripheral surface of the exposure drum 20 by means of a one-way roller 82. To this end, pairs of supply rollers 84, 85 and 86 are disposed adjacent to the roller 82. A guide plate 87 is provided so as to guide the image-receiving material to the gap between these rollers and the outer peripheral surface of the exposure drum 20.

A sensor S2 for sensing the passage of the image-receiving material 76 is disposed between the supply rollers 84 and 85. A spray nozzle 88 serving as a solvent application means is disposed between the supply rollers 85 and 86 so as to apply water as an image-forming solvent to the image-receiving material 76, thereby to improve the transfer efficiency. It is to be noted, however, the provision of the spray nozzle 88 is not essential. Namely, the spray nozzle 88 may be omitted if the image-receiving material used is of the type which contains by itself an image-forming solvent.

As will be seen from FIG. 2, the image-receiving material 76 has a width smaller than that of the heat-developable photosensitive material 16 so that it is not affected by the clip 42. In addition, the leading end of the image-receiving material projects slightly ahead of the leading end of the heat-developable photosensitive material 16 so as to be wound on the exposure drum 20.

An image-receiving material separator arm 92 is rotatably secured at its mid portion to the main part 12 of the apparatus by means of a pin 94, at a position between the transfer pressing roller 66 and the exposure head 60. The separator arm 92 has one end which is connected to an actuator 98 associated with a solenoid SOL4. When the solenoid SOL4 is energized, the other end of the separator arm 92 is brought into a groove 20A (see FIG. 2) formed in the outer peripheral surface of the exposure drum 20, as will be seen from FIG. 4. Therefore, the heat-developable photosensitive material 16 is separated by the separator arm 92 from its leading end off the exposure drum 20 as the latter is rotated clockwise as viewed in FIG. 1. Thus, the arm 92, solenoid SOL4 and the actuator 98 in cooperation constitute first separation means.

A heat-developable photosensitive material separator arm 100 is rotatably secured by a pin 102 to the main part 12 of the apparatus, at a position between the image-receiving material separator arm 92 and the exposure head 60. As the solenoid SOL6 is energized, the heat-developable photosensitive material separator arm 100 is actuated by the actuator 105 and its end is moved into the groove 20A in the surface of the exposure drum 20 so as to separate the heat-developable photosensitive material 16 off the outer peripheral surface of the exposure drum 20 in accordance with the rotation of the latter in the clockwise direction as viewed in FIG. 1. Thus, the arm 100, solenoid SOL5 and the actuator 105 in combination constitute a second separation means.

In order to enable the heat-developable photosensitive material 16 to be separated from the exposure drum 20 by the operation of the separator arm 100, it is necessary that the clip 42 be released to unclamp the heat-developable photosensitive material 16. This is achieved by a clip release roller 96 which is attached to an end of a clip release arm 104 which in turn is pivotally secured to the main part 12 of the apparatus by means of a pin 103. The arrangement is such that the clip release arm 104 is rotated by the power of the solenoid SOL5 so as to press the end of the clip 42 remote from the heat-developable photosensitive material 16.

The heat-developable photosensitive material 16 and the image-receiving material 76 separated from the exposure drum 20 are received by trays 110 and 112, respectively.

The operation of the image recording apparatus having the described construction is controlled by a control system which is constituted mainly by a microcomputer 200. The microcomputer 200 is adapted for commencing the control operation upon receipt of a start signal input through a start switch 202. The microcomputer 200 also receives Outputs from the sensors $S_1$ and $S_2$.

The microcomputer 200 as the control means drives the rollers through the operation of a driving circuit 204 and energizes the respective solenoids through the operation of a driving circuit 206. The microcomputer 200 also controls, through the operation of a driving circuit 208, various operations including the rotation of the exposure drum 20, scanning exposure through the exposure head 60, supply of the electric power to the heater 49, operations of the transfer pressing rollers 62, 64 and 66, and the operation of the water application nozzle 88.

Figure 7:
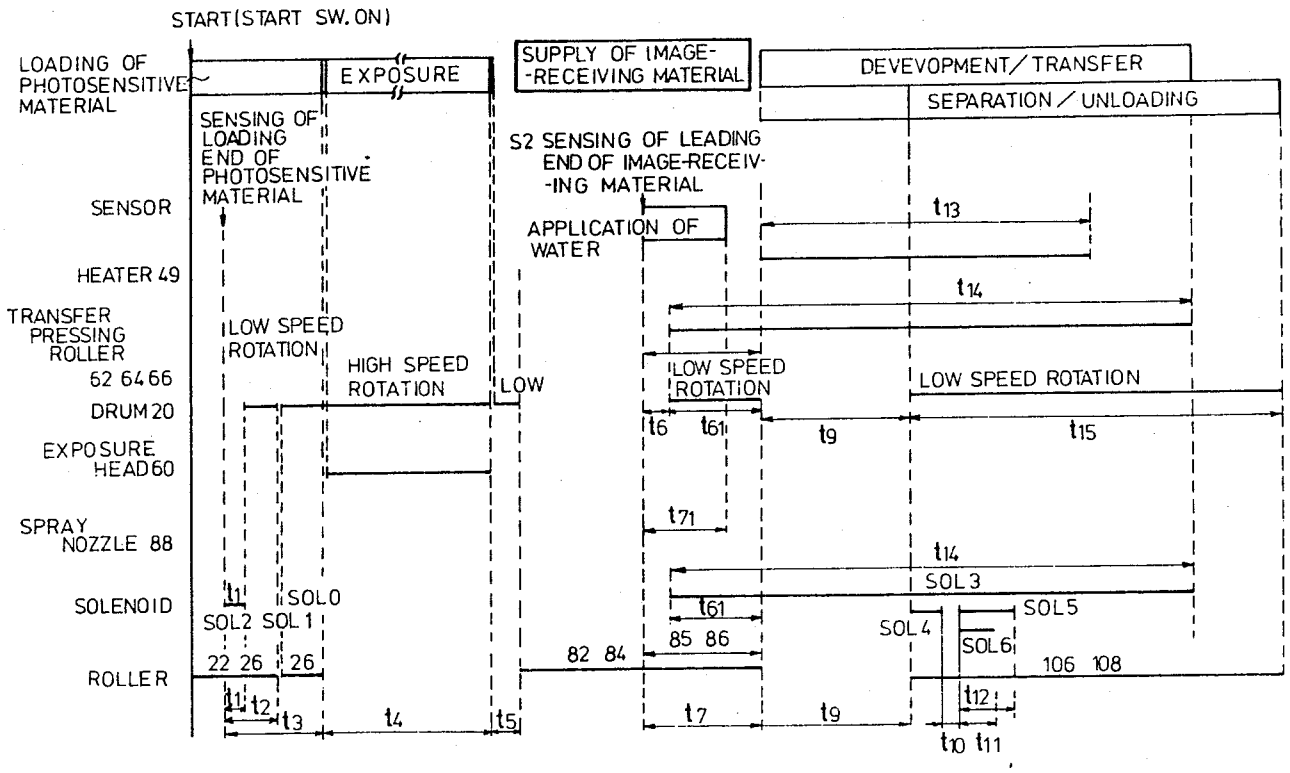
FIG. 7 is a time chart illustrating the operation of the embodiment shown in FIG. 1.
Figure 8:
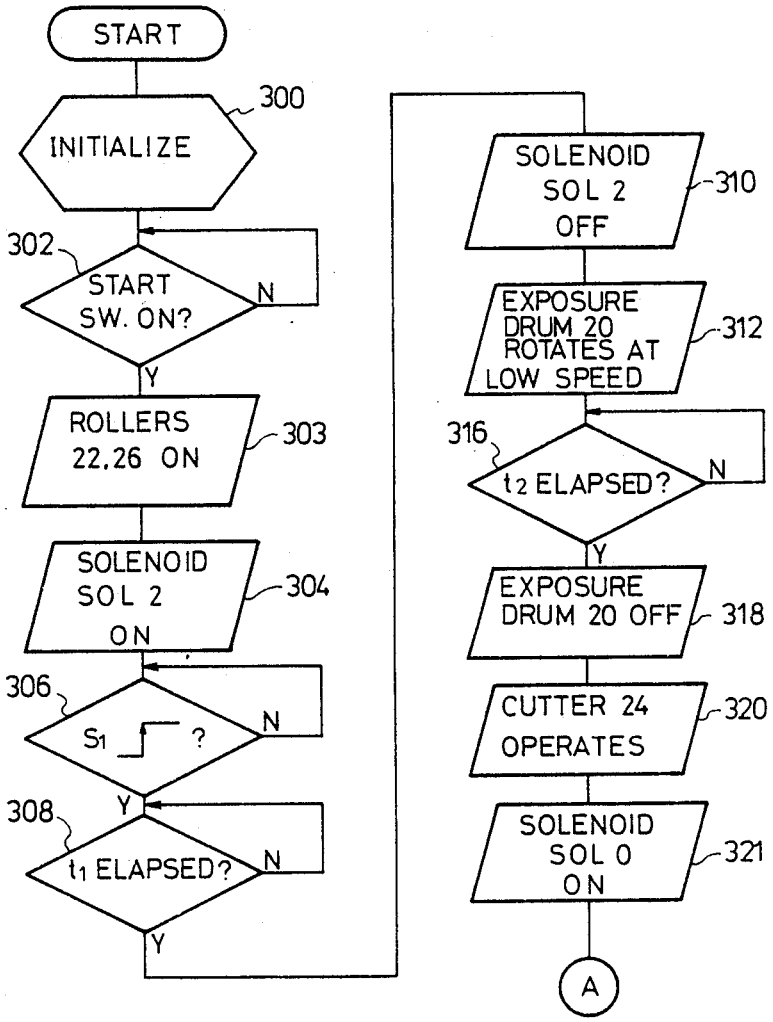
FIGS. 8(A)–(E) are flow charts illustrating the operation of the embodiment shown in FIG. 1.
Figure 8:
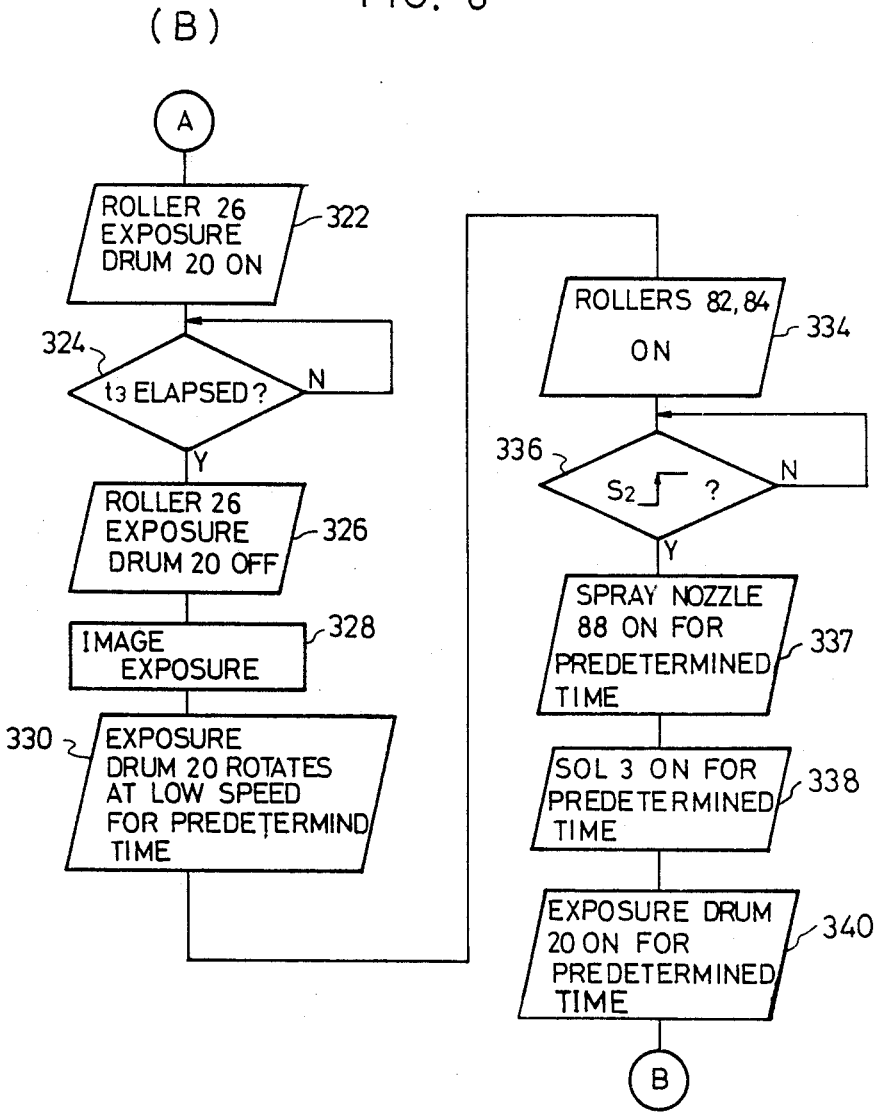
Figure 8:
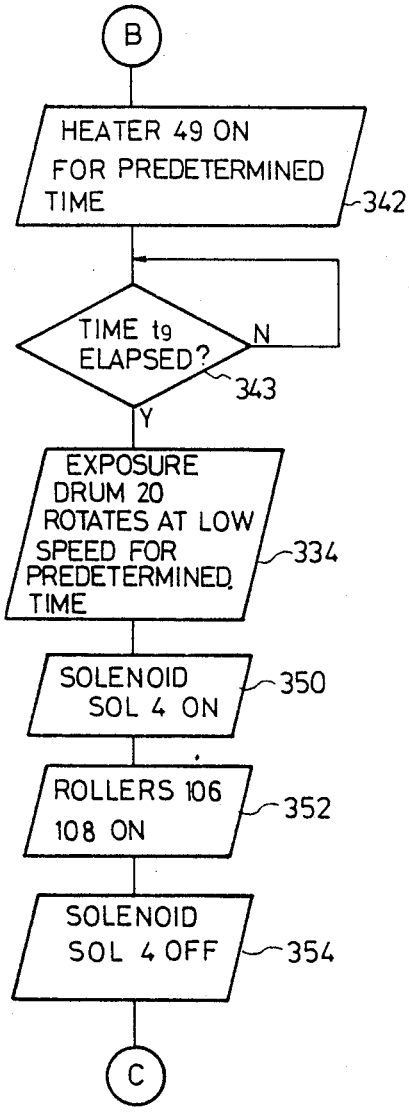
Figure 8:
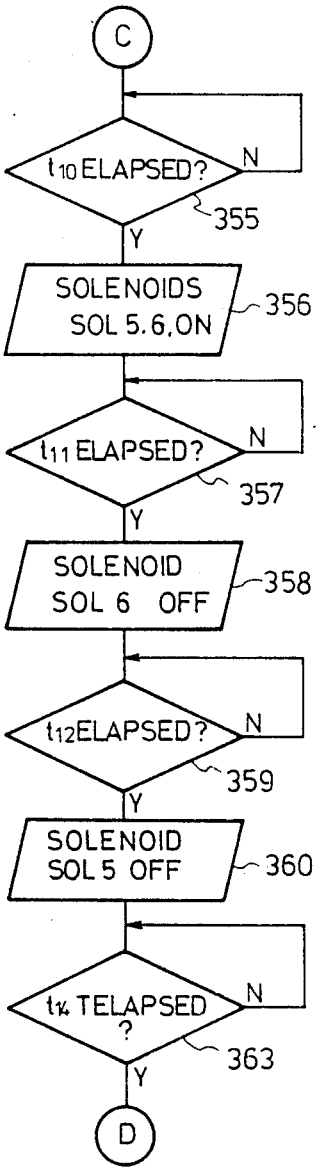
Figure 8:
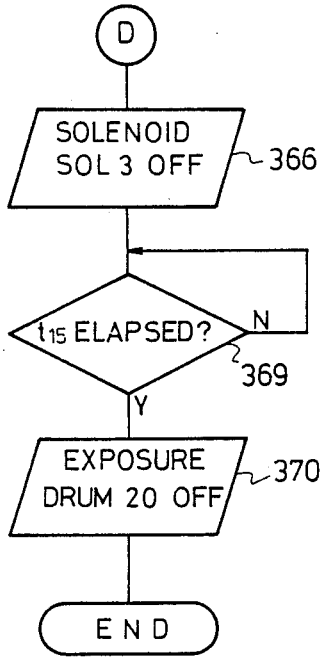

The operation of this embodiment will be described hereinunder following the steps shown in a flow chart in FIG. 8, with reference to a time chart shown in FIG. 7.

In Step 300, work areas of a RAM in the microcomputer 200 are initialized, thus initializing the outputs therefrom. Then, as the start switch 202 is turned on in Step 302, the driving rollers 22 and 26 are operated in Step 303. As a result, the heat-developable photosensitive material 16 is extracted from the magazine 14 and is fed towards the clip 42 which has been set in the condition as shown in FIG. 1. Then, the solenoid SOL2 is energized in Step 304 so that the clip 42 is swung by the roller 50 so that the end of the clip 42 adjacent to the exposure drum 20 is moved away from the flattened surface 36, thus forming a gap for receiving the leading end of the heat-developable photosensitive material 16.

Then, the microcomputer waits for the rise of a pulse from the sensor $S_1$, i.e., the detection of the leading end of the heat-developable photosensitive material 16 by the Sensor $S_1$ (Step 306). Subsequently, after a predetermined time $t_1$ has passed (Step 308), the microcomputer 200 operates to de-energize the solenoid SOL2 (Step 310). The length of the time $t_1$ is the time required for the leading end of the heat-developable photosensitive material 16 to reach the step 36A of the flattened surface 36. At the same time, the exposure drum 20 starts to rotate at a low speed in Step 312. In consequence, the clip 42 is moved together with the exposure drum 20 while clamping the heat developable photosensitive material 16 between itself and the flattened surface 36 by the urging force of the spring 46, thus allowing the heat-developable photosensitive material 16 to be wound around the exposure drum 20. To this end, the driving rollers 22, 26 are operated at the same peripheral speeds as the exposure drum 20.

In Step 316, a judgement is conducted as to whether predetermined time $t_2$ has passed after the operation of the sensor $S_1$. After elapse of the time $t_2$, the power to the exposure drum 20 is turned off in Step 318, so that the heat-developable photosensitive material 16 is cut by the cutter 24 in Step 320. The length of the time $t_2$ is selected to be enough for allowing the heat-developable photosensitive material 16 to be wound on the outer peripheral surface of the exposure drum 20 by a required length.

Then, the solenoid SOL0 is energized to release the nip of the rollers 22 and the roller 26 and the exposure drum 20 are started again to rotate at low speeds (Steps 321, 322). When predetermined time $t_3$ has passed thereafter, the roller 26 and the exposure drum 20 are turned off in Steps 324 and 326, whereby the whole length of the heat-developable photosensitive material 16 downstream from the cutter 24 is taken up by the exposure drum 20.

Figure 3:
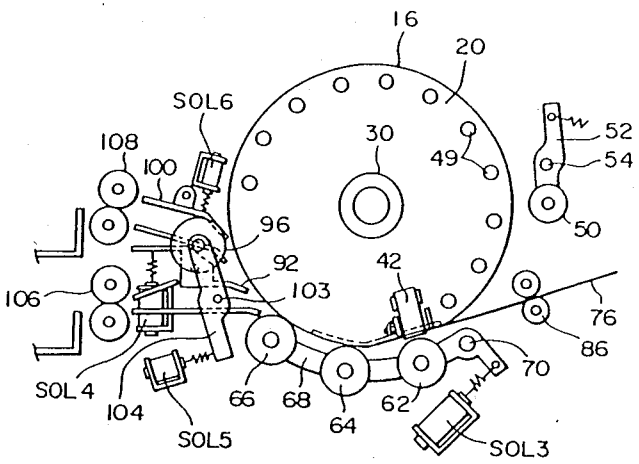
FIG. 3 is an illustration of a portion of the embodiment shown in FIG. 1, in a step of operation thereof.

Then, the exposure drum 20 starts to rotate at a high speed, and the exposure head 60 is activated so as to allow the heat-developable photosensitive material 16 to be exposed to an original image. After predetermined time $t_4$ long enough to complete the exposure has passed, the exposure head 60 is stopped thus completing the exposure in Step 328. Thereafter, the exposure drum 20 is rotated at a low speed through predetermined time $t_5$ and is stopped at the position shown in FIG. 3 in Step 330.

Subsequently, the rollers 82 and 84 are activated so as to supply the image-receiving material 76 onto the outer peripheral surface of the exposure drum 20 (Steps 333, 334). When the image-receiving material 76 has reached the position where the sensor $S_2$ is located, water as the image-forming solvent is applied to the image-receiving material 76 by the operation of the spray nozzle 88 (Step 337).

Then, the solenoid SOL3 is energized so that the transfer pressing rollers 62, 64 and 66 operate to press the image-receiving material into close contact with the outer peripheral surface of the photosensitive material 16 in Step 338. When predetermined time $t_6$ has passed thereafter, the exposure drum 20 is rotated at a low speed for a predetermined period so that the image-receiving material 76 is wound on the heat developable photosensitive material 16 which has been wound on the exposure drum 20 (Step 340).

Then, the exposure drum 20 is stopped and the heater 49 is turned on, thereby starting development of the latent image on the Heat-developable photosensitive material 16 by application of heat, as well as the transfer of the thus developed image onto the image-receiving material 76 (Step 342). In this embodiment, the exposure drum continues to rotate during the development and the transfer of the image, although it may be kept still.

Figure 4:
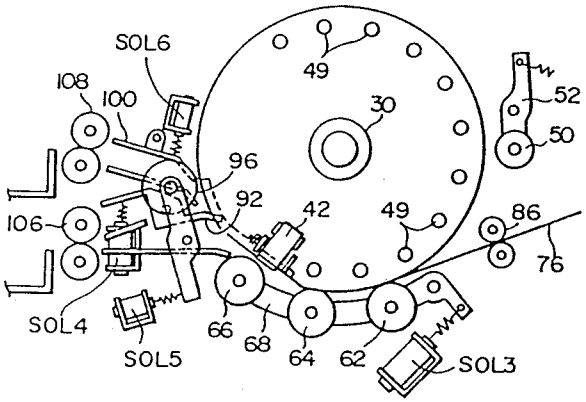
Figure 6:
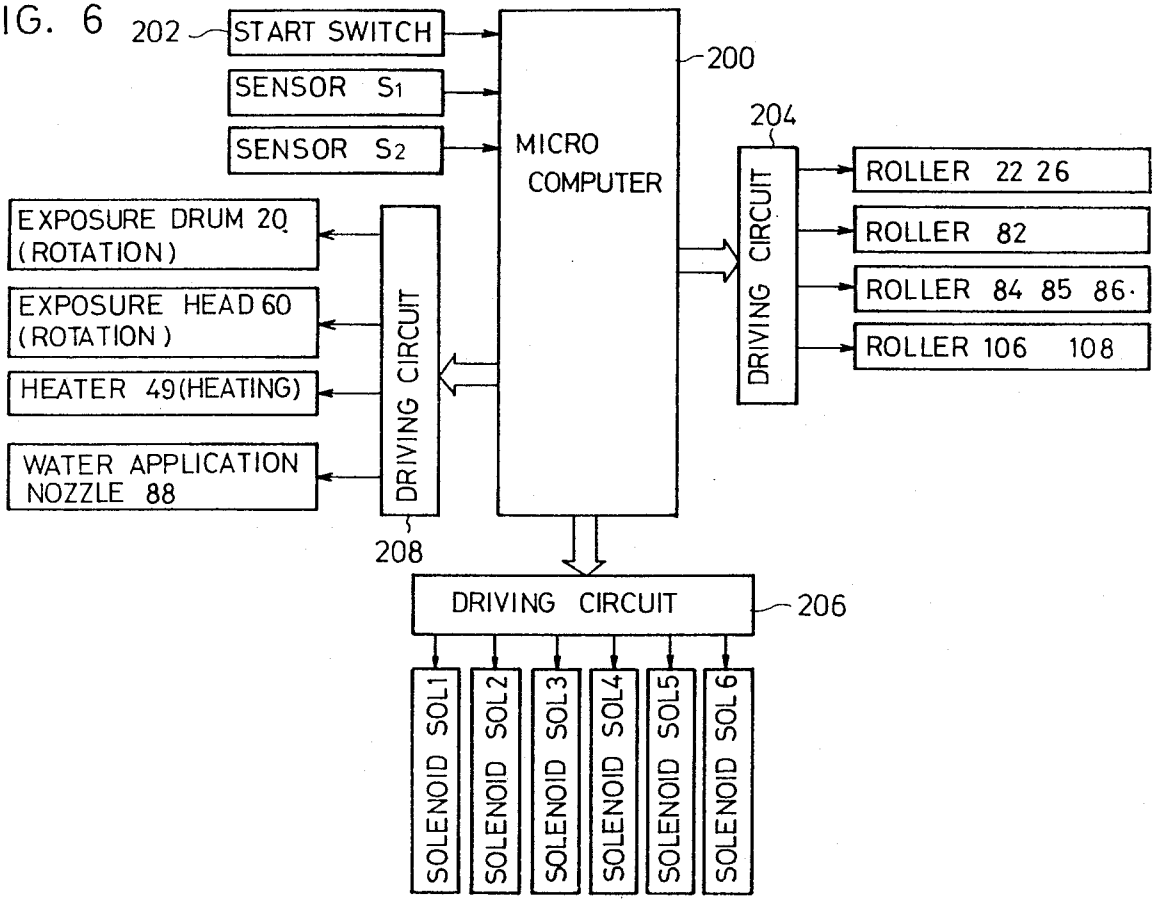
FIG. 6 is a circuit diagram of a control circuit incorporated in the embodiment shown in FIG. 1.

When predetermined time $t_9$ which is long enough to ensure safe development and transfer of the image has passed, the exposure drum 20 starts to rotate so that the solenoid SOL4 is driven to bring the leading end of the image-receiving material separator arm 92 into the groove 20A as shown in FIG. 4 (Steps 342 to 344). Simultaneously, the rollers 106 and 108 are driven in Step 352 so that the separation and unloading of the leading portion of the image-receiving material are started while the transfer to the trailing portion of the image-receiving material 76 is still being executed. The leading end of the image-receiving material 76 separated by the separator arm 92 is transferred into the tray 110 past the roller 100. Then, the solenoid SOL4 is de-energized in Step 354. This does not cause any inconvenience because the leading end of the image-receiving material 76 has already been separated. In addition, the separation of the heat-developable photosensitive material 16 is not caused because the leading end of the heat developable photosensitive material is behind that of the image-receiving material 76.

When predetermined time $t_{10}$ has passed thereafter, both the solenoids SOL5 and SOL6 are turned on in Steps 355 and 356 so that the clip release arm 104 contacts the clip 42 which is rotated together with the exposure drum 20, thus releasing the leading end of the heat developable photosensitive material 16. In addition, since the heat-developable photosensitive material separator arm 100 comes into the groove 20A, the released leading end of the heat-developable photosensitive material 16 is separated from the exposure drum 20 and is delivered to the tray 112 through the roller 108, whereby the separation and unloading operation of commenced.

After elapse of predetermined time $t_{11}$, the solenoid SOL6 is turned off so that the heat-developable photosensitive material separator arm 100 is reset (Steps 357, 358) and, after elapse of predetermined time $t_{12}$, the solenoid SOL5 is turned off (Steps 359, 360) so that the solenoid SOL4 contacts the exposure drum 20. This, however, does not cause any problem because the leading end of the heat-developable photosensitive material 16 has already been separated from the exposure drum 20. Thus, the image-receiving material 67 undergoes a series of steps including application of water, transfer, separation and delivery to the tray 110, while the heat-developable photosensitive material 16 is treated through a series of steps including the transfer, separation and the delivery to the tray 112, from the leading end to the trailing end thereof.

When the image-receiving material 76 has passed by the transfer pressing rollers 62, 64 and 66, i.e., after elapse of predetermined time $t_{14}$, the solenoid SOL3 is de-energized in Step 366 so that the transfer pressing rollers 62, 64 and 66 are moved away from the exposure drum 20.

After elapse of predetermined time $t_{15}$, the trailing ends of the image-receiving material 76 and the heat-developable photosensitive material 16, which are being delivered to the respective trays 110 and 112, are completely received in these trays, so that the rollers 106 and 108 are activated to complete the loading operation in Steps 369 and 370, thus completing a series of recording operation including the exposure, development and the transfer.

As will be understood from the foregoing description, the image-receiving material carrying the image transferred thereto is collected in the tray 110, while the heat-developable photosensitive material 16 after the transfer is collected in the tray 112 for an easy disposal.

Figure 9:
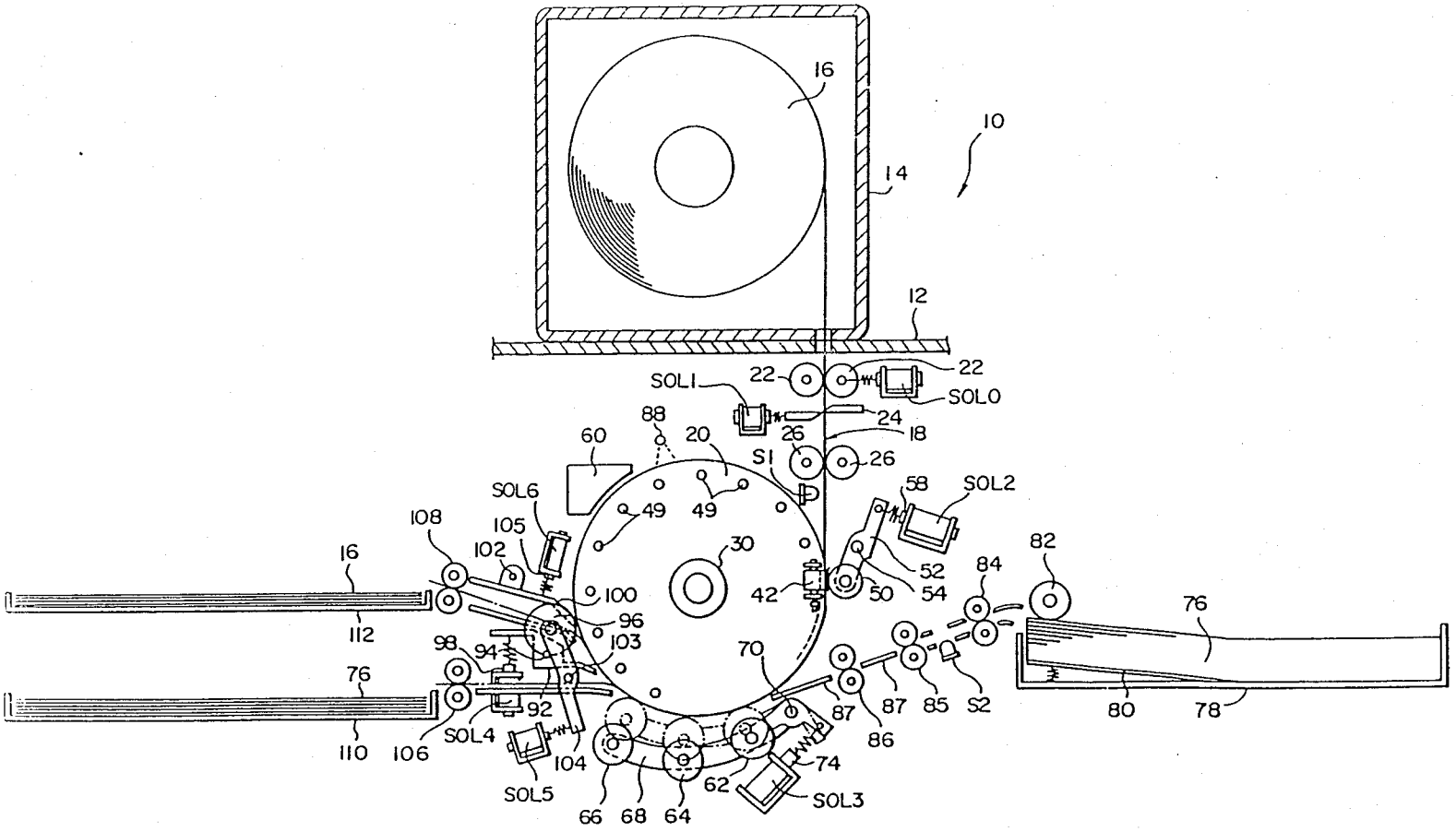
FIG. 9 is a sectional view similar to FIG. 1 but showing a second embodiment of the present invention.

FIG. 9 shows a second embodiment of the present invention in which the spray nozzle 88 is disposed so as to confront the outer peripheral surface of the exposure drum 20, in contrast to the first embodiment in which the spray nozzle is disposed between the supply rollers 85 and 86.

In operation, the spray nozzle 88 applies the water as the image-forming solvent to the emulsifier surface on the heat-developable photosensitive material 16 before the image-receiving material 78 is wound on the heat developable photosensitive material 16, thus improving the efficiency of transfer of the image.

Although in the described embodiments the image-forming solvent is applied by means of a spray nozzle, the image-forming solvent may be applied by other suitable application means such as an applicator impregnated with water, ink jet, mist spray, wire bar, gravure coating, dipping and so forth. Other portions are materially the same as that in the foregoing embodiments.

It is to be noted also that the heater 49 which generates heat for heat-development and transfer of the image need no always be installed in the exposure drum. Namely, the heat-development and transfer of the image may be effected by an exposure drum 20 which is disposed so as to face the outer peripheral surface of the exposure drum 20 and adapted for externally heat the heat-developable photosensitive material 16 and the image-receiving material 76 superposed on the exposure drum 20.

In addition, the supply of the image-forming solvent may be disposed along the path of the image-receiving material so that the image-receiving material is supplied with the solvent before it is wound on the exposure drum.

As will be understood from the foregoing description, the image recording apparatus in accordance with the present invention has an exposure drum capable of holding a heat-developable photosensitive material wound thereon, an exposure head disposed to oppose to the outer peripheral surface of the exposure drum and adapted for allowing the heat-developable photosensitive material on the exposure drum to be exposed, an image-receiving material supply means for supplying an image-receiving material onto the heat-developable photosensitive material on the exposure drum, and developing and transfer means for heating the heat-developable photosensitive material so as to develop an image carried by the photosensitive drum and to transfer the developed image to the image-receiving material. Thus, a series of operation including exposure, heat-development and transfer of the image can be conducted while the heat-developable photosensitive material is held on the outer peripheral surface of the exposure drum, thus enabling the size of the image recording apparatus to be reduced remarkably.

What is claimed is:

1. An image recording apparatus of the type in which a latent image formed on a heat-developable photosensitive material through exposure is developed and the developed image is then transferred to an image-receiving material so as to be recorded on said image-receiving material, comprising:

an exposure drum for holding said heat-developable photosensitive material wound on the outer peripheral surface thereof;

an exposure head disposed to face the outer peripheral surface of said exposure drum for exposing said heat-developable photosensitive material on said exposure drum to an original image;

image-receiving material supplying means for supplying said image-receiving material onto said heat-developable photosensitive material on said exposure drum so as to wind said image-receiving material on said heat-developable photosensitive material; and developing transfer means for applying heat to said heat-developable photosensitive material and said image-receiving material on said exposure drum so as to develop the latent image on said heat-developable photosensitive material while said heat-developable photosensitive material and image-receiving material are in contact with one another and to transfer the developed image to said image-receiving material.

2. An image recording apparatus according to claim 1, wherein said developing transfer means includes a heater incorporated in said exposure drum.

3. An image recording apparatus according to claim 1, further comprising heat-developable photosensitive material supplying means for supplying said heat-developable photosensitive material onto said exposure drum so as to make said heat-developable photosensitive material be held on the outer peripheral surface of said exposure drum.

4. An image recording apparatus according to claim 3, further comprising image-receiving material separation means for separating said image-receiving material from said heat-developable photosensitive material after the transfer of the image and heat-developable photosensitive material separation means for separating said heat-developable photosensitive material from said exposure drum after the transfer of the image.

5. An image recording apparatus according to claim 4, further comprising pressing means disposed to face the outer peripheral surface of said exposure drum for pressing said image-receiving material fed by said image-receiving material supply means into close contact with said heat-developable photosensitive material on said exposure drum.

6. An image recording apparatus according to claim 5, further comprising locating means for locating said heat-developable photosensitive material fed by said heat-developable photosensitive material supplying means at a predetermined position on said exposure drum.

7. An image recording apparatus according to claim 6, further comprising solvent application means for applying an image-forming solvent to at least one of said heat-developable photosensitive material and said image-receiving material so as to improve the efficiency of the transfer of the image.

8. An image recording apparatus according to claim 7, further comprising: first detection means for detecting the supply of said heat-developable photosensitive material by said heat-developable photosensitive material supplying means onto the outer peripheral surface of said exposure drum; second detection means for detecting the supply of said image-receiving material by said image-receiving material supplying means onto said heat-developable photosensitive material on said exposure drum; and control means for controlling, in accordance with the outputs from said first and second detection means, the operation of said exposure drum, said exposure head and said developing transfer means, so as to effect a series of operations including the exposure of said heat-developable photosensitive material, development of the latent image on said heat-developable photosensitive material and the transfer of the developed image onto said image-receiving material.

9. An image recording apparatus according to claim 7, wherein said solvent application means is disposed to face the outer peripheral surface of said exposure drum so as to apply said image-forming solvent onto said heat-developable photosensitive material on said exposure drum.

10. An image recording apparatus according to claim 7, wherein said solvent application means is disposed along the path of supply of said image-receiving material so as to be able to apply said image-forming solvent to said image-receiving material before said image-receiving material is wound around said heat-developable photosensitive material on said exposure drum.

11. An image recording apparatus of the type in which a latent image formed on a heat-developable photosensitive material through exposure is developed and the developed image is then transferred to an image-receiving material so as to be recorded on said image-receiving material, comprising:

an exposure drum for holding said heat-developable photosensitive material wound on the outer peripheral surface thereof;

heat-developable photosensitive material supplying means for supplying said heat-developable photosensitive material onto the outer peripheral surface of said exposure drum so as to wind said heat-developable photosensitive material on the outer peripheral surface of said exposure drum;

an exposure head disposed to face the outer peripheral surface of said exposure drum for exposing said heat-developable photosensitive material on said exposure drum to an original image;

image-receiving material supplying means for supplying said image-receiving material onto the outer peripheral surface of said exposure drum so as to wind said image-receiving material around said heat-developable photosensitive material on said exposure drum;

solvent application means for applying an image-forming solvent to at least one of said heat-developable photosensitive material and said image-receiving material; and developing transfer means for applying heat to said heat-developable photosensitive material and said image-receiving material on said exposure drum so as to develop the latent image on said heat-developable photosensitive material while said heat-developable photosensitive material and image-receiving material are in contact with one another and transfer the developed image to said image-receiving material.

12. An image recording apparatus according to claim 11, further comprising first separation means for separating said image-receiving material after the transfer of the image from said heat-developable photosensitive material, and second separation means for separating said heat-developable photosensitive material after the transfer of image from said exposure drum.

13. An image recording apparatus according to claim 12, wherein said developing transfer means includes a heater incorporated in said exposure drum.

14. An image recording apparatus according to claim 13, further comprising locating means for locating said heat-developable photosensitive material fed by said heat-developable photosensitive material supplying means at a predetermined position on said exposure drum.

15. An image recording apparatus according to claim 14, further comprising pressing means disposed to face the outer peripheral surface of said exposure drum for pressing said image-receiving material fed by said image-receiving material supply means into close contact with said heat-developable photosensitive material on said exposure drum.

16. An image recording apparatus according to claim 15, wherein said solvent application means is disposed along the path of supply of said image-receiving material so as to be able to apply said image-forming solvent to said image-receiving material before said image-receiving material is wound around said heat-developable photosensitive material on said exposure drum.

17. An image recording apparatus according to claim 16, further comprising: first detection means for detecting the supply of said heat-developable photosensitive material onto said exposure drum; second detection means for detecting the supply of said image-receiving material onto said exposure drum; and control means operative in response to output signals from said first and second detection means, said control means controlling said locating means so as to locate said heat-developable photosensitive material at said predetermined position on the outer peripheral surface of said exposure drum, controlling said exposure drum and said exposure head so as to enable said heat-developable photosensitive material to be exposed to the original image, controlling said solvent application means so as to apply said image-forming solvent to said image-receiving material while said image-receiving material is being supplied to said exposure drum, controlling said pressing means so as to cause said image-receiving material supplied to said exposure drum to closely contact said heat-developable photosensitive material, controlling said heater so as to heat said heat-developable photosensitive material and said image-receiving material closely contacting each other and held on said exposure drum so as to develop the latent image on said heat-developable photosensitive material and transferring the developed image onto said image-receiving material, controlling said first separation means so as to separate said image-receiving material after the transfer of said image from said heat-developable photosensitive material, and controlling said second separation means after the transfer of the image from said exposure drum.

18. An image recording apparatus according to claim 15, wherein said solvent application means is disposed to face the outer peripheral surface of said exposure drum so as to apply said image-forming solvent to said heat-developable photosensitive material after the exposure on said exposure drum.

19. An image recording apparatus according to claim 18, further comprising: first detection means for detecting the supply of said heat-developable photosensitive material onto said exposure drum; second detection means for detecting the supply of said image-receiving material onto said exposure drum; and control means operative in response to output signals from said first and second detection means, said control means controlling said locating means so as to locate said heat-developable photosensitive material at said predetermined position on the outer peripheral surface of said exposure drum, controlling said exposure drum and said exposure head so as to enable said heat-developable photosensitive material to be exposed to the original image, controlling said solvent application means so as to apply said image-forming solvent to said heat-developable photosensitive material after exposure on said exposure drum, controlling said pressing means so as to cause said image-receiving material supplied to said exposure drum to closely contact said heat-developable photosensitive material, controlling said heater so as to heat said heat-developable photosensitive material and said image-receiving material closely contacting each other and held on said exposure drum thereby developing the latent image on said heat-developable photosensitive material and transferring the developed image onto said image-receiving material, controlling said first separation means so as to separate said image-receiving material after the transfer of said image from said heat-developable photosensitive material, and controlling said second separation means after the transfer of the image from said exposure drum.

20. An image forming apparatus according to claim 11, further comprising control means for controlling the rotation of said exposure drum, exposure through said exposure head, application of said image-forming solvent by said solvent application means, and the development and transfer of the image by said developing transfer means.

* * * * *